US006585541B2

(12) United States Patent
Higashida et al.

(10) Patent No.: US 6,585,541 B2
(45) Date of Patent: Jul. 1, 2003

(54) ELECTRICAL CONNECTION BOX

(75) Inventors: Yasushi Higashida, Tokyo (JP); Tomotaka Watanabe, Tokyo (JP); Kazuo Miyajima, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/972,670

(22) Filed: Oct. 5, 2001

(65) Prior Publication Data

US 2002/0025700 A1 Feb. 28, 2002

Related U.S. Application Data

(63) Continuation of application No. PCT/JP00/01363, filed on Mar. 7, 2000.

(51) Int. Cl.[7] ..... H01R 12/00; H01R 13/68; H05U 1/00; H01H 85/02; H01H 85/20

(52) U.S. Cl. ..... 439/622; 439/621; 439/76.2; 337/186

(58) Field of Search ..... 439/76.2, 621, 439/622; 337/186

(56) References Cited

U.S. PATENT DOCUMENTS

| | | | | | |
|---|---|---|---|---|---|
| 5,145,414 | A | * | 9/1992 | Oikawa | 439/374 |
| 5,171,293 | A | * | 12/1992 | Umemoto et al. | 439/622 |
| 5,451,173 | A | * | 9/1995 | Mai | 439/622 |
| 5,488,345 | A | * | 1/1996 | Seki et al. | 337/186 |
| 5,680,088 | A | * | 10/1997 | Seki et al. | 337/194 |
| 5,751,208 | A | * | 5/1998 | Martinez | 337/194 |
| 5,800,043 | A | * | 9/1998 | Walkerow | 362/119 |
| 5,816,858 | A | * | 10/1998 | Kazarian et al. | 439/366 |

* cited by examiner

*Primary Examiner*—Chandrika Prasad
(74) *Attorney, Agent, or Firm*—Knobbe Martens Olson & Bear LLP

(57) ABSTRACT

An electrical connection box with a plurality of housings including those for a dark current provided therein. The fuse housing 4 for a dark current comprises a connecting portion 4*a* to which a fuse for a dark current is electrically connected, and an accommodating portion 4*b* in which the fuses for a dark current are accommodated.

5 Claims, 3 Drawing Sheets

ELECTRICAL CONNECTION BOX

This application is a continuation of, and incorporates by reference, in its entirety, PCT/JP00/01363, filed Mar. 7, 2000, which was published in Japanese.

FIELD OF THE INVENTION

The present invention relates to an electrical connection box with a fuse used in vehicles or other applications.

BACKGROUND TECHNOLOGY

In a prior art-based electrical connection box such as that used, for instance, in a vehicle, a plurality of housings are provided, and various types of fuses each having a different capacity and terminals of various types of electric components are attached to these housings respectively for connection to electric circuits of various types of electric instruments installed in a vehicle. Electricity to this electrical connection box for a vehicle is supplied from a battery as a power source, and the electric connection to the battery is maintained even when the vehicle is not driven. Therefore, in a vehicle using an electric connection box of this type, an electric circuit such as an electric circuit for a clock which always consumes electric power (hereinafter referred to as "dark current circuit") is not provided with means for interrupting an electric current, and an electric current is flowing in such an electric circuit even when the vehicle is not driven, and an electric current is always flowing even when the vehicle is not driven. Because of this feature, in a vehicle using the electrical connection box described above, a fuse for the dark current circuit is removed from the fuse housing (described as "fuse for a dark current" hereinafter) to disconnect the electric current when the vehicle is shipped from a plant or while the vehicle is stored at a dealer's site, thus depletion of the battery while the vehicle is not driven for a long time being prevented.

When a vehicle is not driven for a long time as described above, the fuse for a dark current is separately stored until the vehicle is driven again.

When the fuse is stored for a long time, however, one may disadvantageously forget the site where the fuse for a dark current is stored. In addition, if there are various types of fuses for a dark current each having a different capacity respectively at the storage site, sometimes one may disadvantageously attach, when again attaching the stored fuse to the vehicle, a fuse different from the required one and having a different capacity even to a different position.

It is an object of the present invention to provide an electrical connection box which makes it possible for one to store the fuse for a dark current without forgetting the storage site when the vehicle is not driven for a long time and also to correctly reattach the fuse for a dark current to the original position without making a mistake in recognizing the position for attachment.

DISCLOSURE OF THE INVENTION

To achieve the object described above, the electrical connection box of the present invention is of the constitution having a plurality of housings each including a fuse housing for a dark current provided therein, and the fuse housing for a dark current comprises a connecting portion to which the fuse for a dark current is attached for electric connection to a prespecified electric current and an accommodating portion for accommodating therein the fuse for a dark current.

As the fuse housing according to the present invention has the connecting portion to which the fuse for a dark current is attached for electric connection to a prespecified electric current and the accommodating portion for accommodating therein the fuse for a dark current, one never forgets the storage site by accommodating the fuse for a dark current removed from the connecting portion in the accommodating portion. In addition, the fuse for a dark current once removed from the connecting portion can readily be attached again to the original connecting portion, thus the possibility of attaching a fuse for a dark current having a different capacity to a different position being eliminated.

BRIED DESCRIPTION OF THE DRAWINGS

BEST MODE FOR CARRYING OUT THE INVENTION

One embodiment of the present invention according to the present invention is described in detail below with reference to FIG. 1 to FIG. 4.

Figure 1:
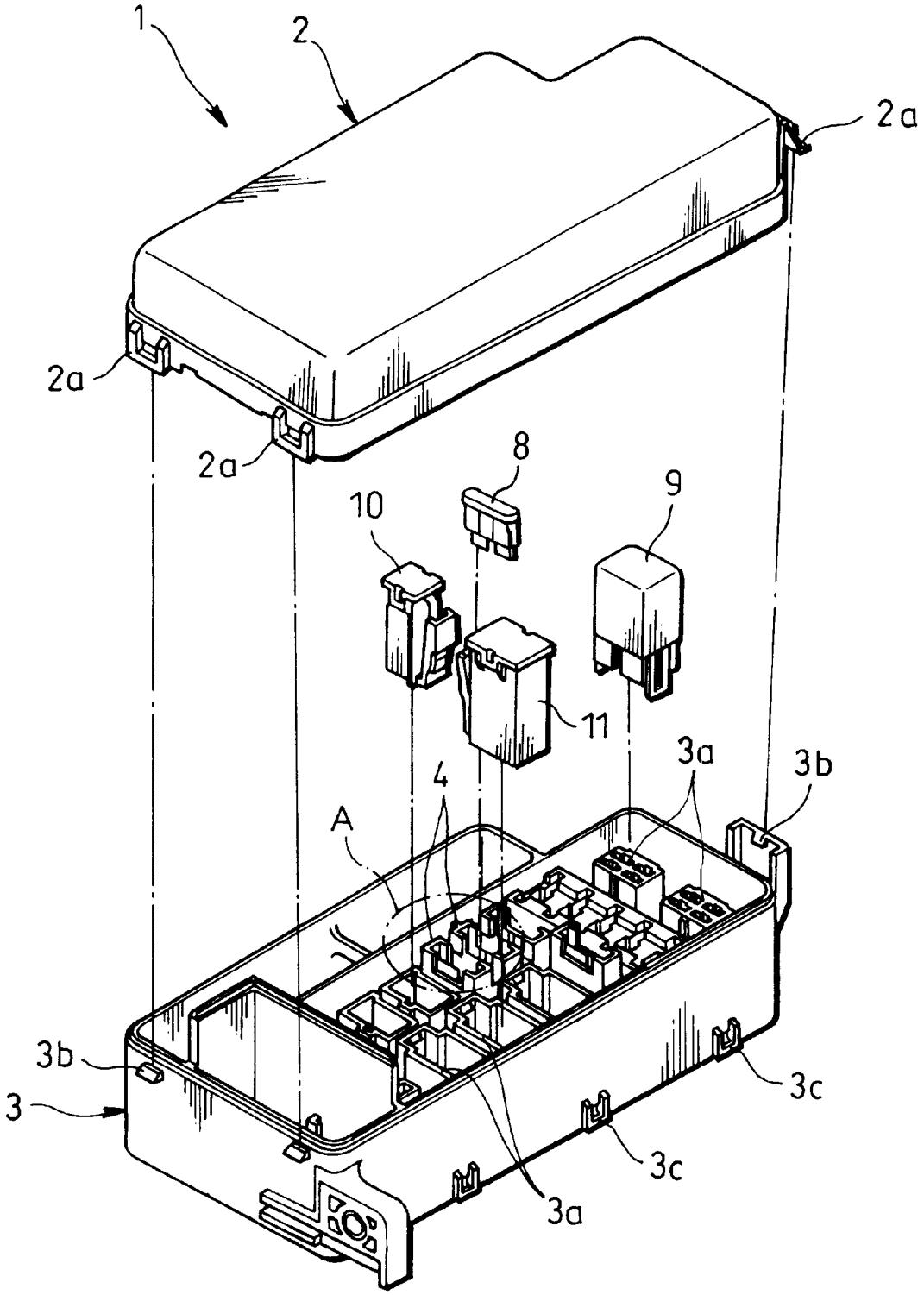
FIG. 1 is a developed perspective view showing one embodiment of the electrical connection box according to the present invention.

An electrical connection box 1 comprises an upper cover 2 and a base box 3 as shown in FIG. 1, and a lower cover not shown is attached to a lower section of the base box 3.

The upper cover 2 is a cover which is set over the base box 3 as shown in FIG. 1, and an engagement portion 2*a* is provided at an appropriate part.

Figure 2:
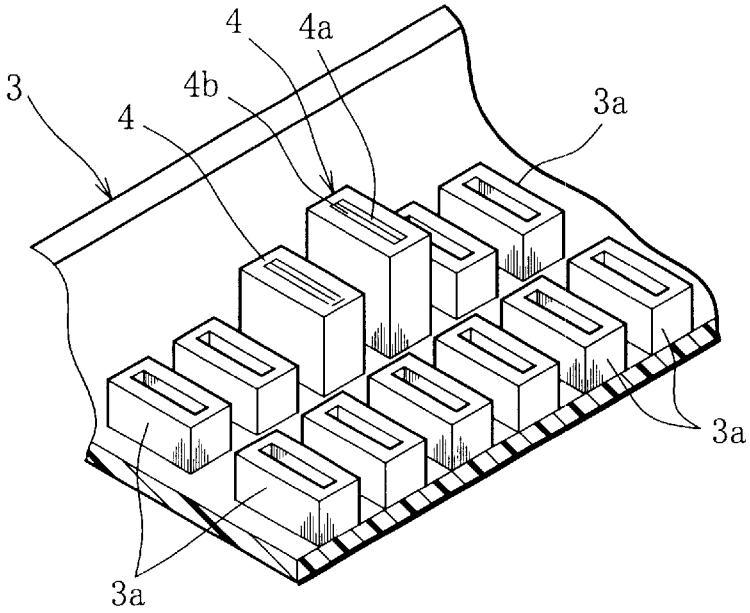
FIG. 2 is an enlarged view of the section A in FIG. 1 and shows a fuse housing for a dark current provided in a base box of the electrical connection box.

As shown in FIG. 1 and FIG. 2, a plurality of housings 3*a* including a fuse housing 4 for a dark current and having various forms respectively are provided on an upper surface of the base box 3, and a hook 3*b* for engagement with an engagement portion 2*a* of the upper cover 2 is provided at an appropriate part on the side surface, and an engagement portion 3*c* at an appropriate part in a lower part of the side surface respectively. A fuse 8 for a dark current is attached to each fuse housing 4 for a dark current, and various electronic components such as a relay 9, a first main fuse 10, and a second main fuse 11 to other housings 3*a* respectively for electric connection to a prespecified electric current not shown in the figures.

Figure 3:
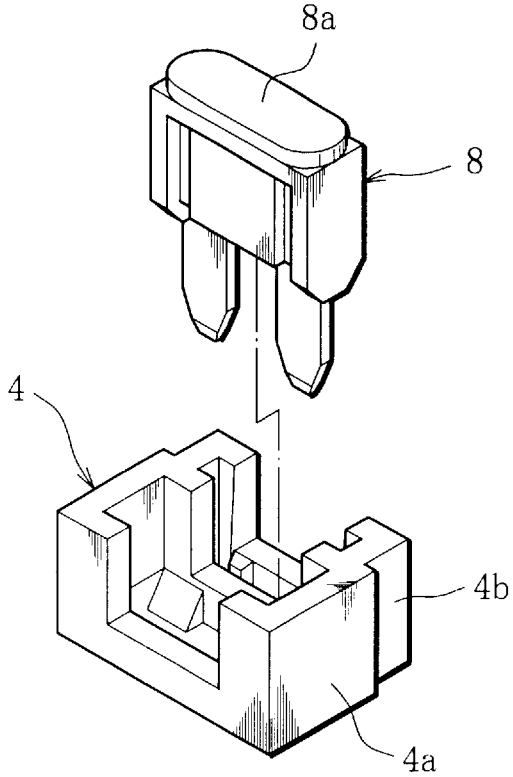
FIG. 3 is an enlarged perspective view showing the fuse housing for a dark current shown in FIG. 2 and a state in which a fuse for a dark current is attached thereto.

As shown in FIG. 3, the fuse housing 4 for a dark current has a connecting portion 4*a* to which various fuses 8 each for a dark current and having a different capacity are attached for electric connection to a prespecified electric circuit, and an accommodating portion 4*b* for accommodating therein the fuses 8 for a dark current. The connecting portion 4*a* and accommodating portion 4*b* are formed so that the two sections can be integrated with each other. The fuse housing 4 for a dark current is formed so that the fuse housing 4 is higher than other housings 3*a*. Because of this feature, in the electrical connection box 1, the fuse housing 4 for a dark current can easily be discerned from other housings 3*a*, and in addition, the fuse 8 for a dark current can readily be pulled off from the connecting portion 4*a* of the fuse housing 4 for a dark current without being disturbed by other adjoining housings 3*a*.

Figure 4:
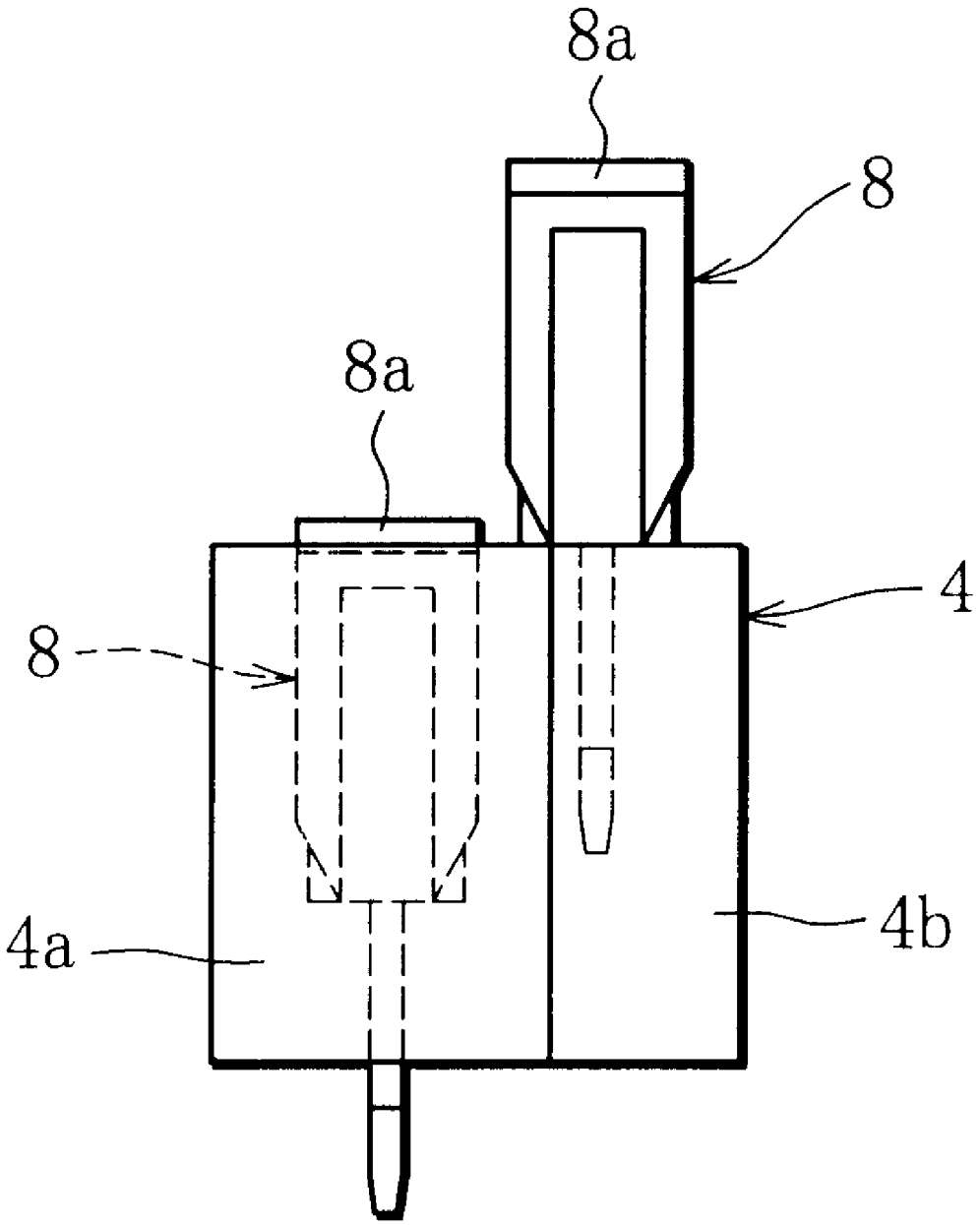
FIG. 4 is a side view showing the state where the fuse for a dark current has been attached to the fuse housing for a dark current.

Further, as shown in FIG. 4, the fuse 8 for a dark current is deeply inserted into and secured to the connecting portion 4*a*, while it is inserted into the accommodating portion 4*b* so that a head portion 8*a* thereof projects therefrom to remarkably show its presence.

The electrical connection box 1 according to this embodiment of the present invention has the configuration in which the connecting portion 4*a* and accommodating portion 4*b* are integrally provided in the fuse housing 4 for a dark current and the fuse 8 for a dark current is accommodated in the accommodating portion 4*b* so that the head portion 8*a* thereof projects therefrom. Because of this configuration, when a vehicle with the electrical connection box 1 loaded therein is shipped from a plant or stored at a dealer's site, depletion of a battery in the electrical connection box 1 can be prevented, when the vehicle is not driven for a long time, by removing the fuse 8 for a dark current from the fuse housing 4 to disconnect an electric current thereto.

In this step, the fuse 8 for dark current removed from the connecting portion 4*a* of the fuse housing 4 can be stored in the adjoining accommodating portion 4*b* until the vehicle is driven again. Because of this configuration, even if the removed fuse 8 for a dark current is stored for a long time in the electrical connection box 1, the storage site of the fuse 8 for a dark current is never forgotten. Further, even if there are several types of fuses 8 each for a dark current and having a different capacity in the electrical connection box 1, as the removed fuse 8 is required only to be connected to the adjoining connecting portion 4*a* from the accommodating portion 4*b* in which the fuse 8 is stored, there never occurs the error that a fuse having a different fuse is attached to an erroneous section when the removed fuse 8 is attached again to the fuse housing 4.

INDUSTRIAL APPLICABILITIES

With the electrical connection box according to the present invention, the fuse for a dark current can be stored without forgetting the storage site when the vehicle is not driven for a long time, and in addition, the fuse for a dark current once removed from the original position can accurately be attached to the original position, when again attached, without committing a mistake in recognizing the original position.

What is claimed is:

1. An electrical connection fuse box with a plurality of fuse housings including at least one for a dark current fuse provided therein, the electrical connection fuse box comprising a dark current fuse, wherein said fuse housing for a dark current fuse comprises a connecting portion for electric connection of the dark current fuse to a prespecified electric circuit and an accommodating portion for accommodating therein the fuse for the dark current, wherein an insertion path of the fuse in the accommodating portion is different than an insertion path of the fuse in the connecting portion, wherein, when the fuse for the dark current is connected to the connection portion, power is provided to the prescribed circuit.

2. The electrical connection fuse box of claim 1, wherein the accommodating portion accommodates the dark current fuse.

3. The electrical connection fuse box of claim 1, wherein the fuse housing for the dark current is higher than other housings.

4. The electrical connection fuse box of claim 1, wherein connection portion and the accommodating portion are integrated together.

5. An electrical connection fuse box with a plurality of fuse housings including at least one for a dark current fuse provided therein, the electrical connection fuse box comprising a dark current fuse, wherein said fuse housing for a dark current fuse comprises a connecting portion for electric connection to a prespecified electric circuit and an accommodating portion for accommodating therein the fuse for the dark current, wherein an insertion path of the fuse in the accommodating portion is different than an insertion path of the fuse in the connecting portion.

* * * * *